US011351685B2

(12) United States Patent
Franklin et al.

(10) Patent No.: US 11,351,685 B2
(45) Date of Patent: Jun. 7, 2022

(54) HAIR GROOMING APPLIANCE

(71) Applicant: Spectrum Brands, Inc., Middleton, WI (US)

(72) Inventors: Thomas Franklin, Middleton, WI (US); Michael John deGrood, Middleton, WI (US); Timin Musallam, Middleton, WI (US); Timothy James McIvor, Middleton, WI (US)

(73) Assignee: SPECTRUM BRANDS, INC., Middleton, WI (US)

( * ) Notice: Subject to any disclaimer, the term of this patent is extended or adjusted under 35 U.S.C. 154(b) by 0 days.

(21) Appl. No.: 16/760,785

(22) PCT Filed: Nov. 9, 2018

(86) PCT No.: PCT/US2018/060001

§ 371 (c)(1),
(2) Date: Apr. 30, 2020

(87) PCT Pub. No.: WO2019/094704

PCT Pub. Date: May 16, 2019

(65) Prior Publication Data

US 2020/0324424 A1 Oct. 15, 2020

Related U.S. Application Data

(60) Provisional application No. 62/584,234, filed on Nov. 10, 2017.

(51) Int. Cl.
*B26B 19/38* (2006.01)
*B26B 19/06* (2006.01)
(Continued)

(52) U.S. Cl.
CPC ..... *B26B 19/3853* (2013.01); *B26B 19/063* (2013.01); *B26B 19/20* (2013.01); *B26B 19/28* (2013.01); *B26B 19/3886* (2013.01)

(58) Field of Classification Search
CPC ..... B26B 19/06; B26B 19/20; B26B 19/3886; B26B 19/3853; B26B 19/063;
(Continued)

(56) References Cited

U.S. PATENT DOCUMENTS 3,589,007 A 6/1971 Walton
3,797,109 A * 3/1974 Yamada ..... B26B 19/38 30/43.1

(Continued)

FOREIGN PATENT DOCUMENTS

CN 101468469 A 7/2009
CN 106564078 A 4/2017

OTHER PUBLICATIONS

ISR Search Report for application No. PCT/US201806001, dated Jul. 16, 2021, 3 pages.

(Continued)

*Primary Examiner* — Ghassem Alie
(74) *Attorney, Agent, or Firm* — Armstrong Teasdale LLP

(57) ABSTRACT

A hair grooming appliance includes a hair grooming device, a drive assembly, and a handle. The drive assembly is coupled to the hair grooming device and configured to drive the hair grooming device. The hair grooming device and the handle are pivotably connected at a hinge and rotate relative to each other about a pivot axis extending through the hinge between an opened position and a closed position.

21 Claims, 11 Drawing Sheets

(51) Int. Cl.
*B26B 19/20* (2006.01)
*B26B 19/28* (2006.01)

(58) Field of Classification Search
CPC ..... B26B 19/28; B26B 19/02; B26B 19/3813; B26B 19/3806
USPC ..... 30/200, 208, 425, 196, 195, 197, 198, 30/199, 201, 43.92, 47, 335, 531, 50, 32
See application file for complete search history.

(56) References Cited

U.S. PATENT DOCUMENTS 4,214,365 A 7/1980 Walter
4,622,745 A * 11/1986 Wahl ..... B26B 19/20 30/201
5,029,390 A * 7/1991 Reeves ..... B26B 21/40 30/536
5,046,249 A * 9/1991 Kawara ..... B26B 21/38 30/45
5,050,304 A * 9/1991 Fujikawa ..... B26B 19/06 30/196
5,206,994 A * 5/1993 Lin ..... B26B 21/24 30/47
7,093,363 B1 * 8/2006 Kuo ..... B26B 21/40 30/32
7,581,319 B1 * 9/2009 Little ..... B26B 19/06 30/210
7,937,837 B2 * 5/2011 Psimadas ..... B26B 21/222 30/34.1
8,033,027 B2 * 10/2011 Leventhal ..... B26B 19/10 30/526
8,091,241 B2 * 1/2012 Ouchi ..... B26B 19/382 30/43.92
8,141,253 B2 * 3/2012 Royle ..... B26B 19/3806 30/34.05
8,584,581 B2 * 11/2013 Curtin ..... A47J 17/02 99/588
9,132,560 B2 * 9/2015 Shimizu ..... B26B 19/02
2003/0209210 A1 * 11/2003 Plante ..... A46B 15/0055 119/625
2005/0011076 A1 1/2005 Andis
2006/0053632 A1 * 3/2006 Khubani ..... B26B 19/02 30/208
2009/0144984 A1 6/2009 Ullmann
2011/0099816 A1 5/2011 Carlucci
2013/0042481 A1 2/2013 Lombardo

OTHER PUBLICATIONS

First Office Action for Patent Application CN 201880085984.4 dated Jul. 5, 2021; 15 pp.

* cited by examiner

HAIR GROOMING APPLIANCE

CROSS-REFERENCE TO RELATED APPLICATIONS

This application is a National Stage application of International Application No. PCT/US2018/060001, filed on Nov. 9, 2018, which claims priority to U.S. Provisional Application No. 62/584,234 filed on Nov. 10, 2017, the entire contents and disclosures of which are incorporated herein by reference in their entirety.

FIELD OF THE DISCLOSURE

The present disclosure relates generally to an electric hair grooming appliance, and more particularly to a foldable electric hair grooming appliance having movements similar to a straightedge razor.

BACKGROUND OF THE DISCLOSURE

Many different types of electric hair grooming appliances are available for use in grooming hair, including foil shavers, rotary shavers, trimmers, clippers, and epilators. Generally, the electric hair grooming appliances are bulky and difficult to store. For example, the hair grooming appliances may require a separate case or cover to protect components of the hair grooming device from damage when not in use. Moreover, some electric hair grooming appliances require an external power source to run the device. As such, most conventional electric hair grooming appliances are not designed specifically for travel and few electric hair grooming appliances are designed specifically to be used outside of the home. Users therefore have limited access to convenient, easily stored hair grooming appliances with on the go capabilities. Thus, there is a need for an electric hair grooming appliance that is compact and easily portable.

SUMMARY

In one aspect, a hair grooming appliance includes a hair grooming device, a drive assembly, and a handle. The drive assembly is coupled to the hair grooming device and configured to drive the hair grooming device. The hair grooming device and the handle are pivotably connected at a hinge and rotate relative to each other about a pivot axis extending through the hinge.

In another aspect, a hair grooming appliance includes a trimmer including a blade assembly, a drive assembly, and a handle. The drive assembly is coupled to the blade assembly. The drive assembly includes an electric drive motor and a linkage. The motor is coupled to the linkage. The linkage is coupled to the blade assembly and configured to reciprocate at least one blade of the blade assembly. The trimmer and handle are pivotably connected at an end of the hair grooming appliance. The trimmer and the handle are configured to pivot between an opened position and a closed position.

In yet another aspect, a hair grooming appliance includes a hair grooming device including at least on of hair cutting assembly and a hair removing assembly. The hair grooming appliance also includes a drive assembly coupled to the hair grooming device and configured to drive the hair grooming device. The hair grooming appliance further includes a handle and a hinge pivotably connecting the handle and the hair grooming device. The hair grooming device and the handle are configured to pivot between an opened position and a closed position about the hinge. The drive assembly is in an ON state when the hair grooming device and the handle are in the opened position. The drive assembly is in an OFF state when the hair grooming device and the handle are in the closed position.

BRIEF DESCRIPTION OF THE DRAWINGS

FIG. 5 is a front end view of the hair grooming appliance shown in

FIG. 1;

Corresponding reference characters indicate corresponding parts throughout the drawings.

DETAILED DESCRIPTION OF THE DRAWINGS

Figure 1:
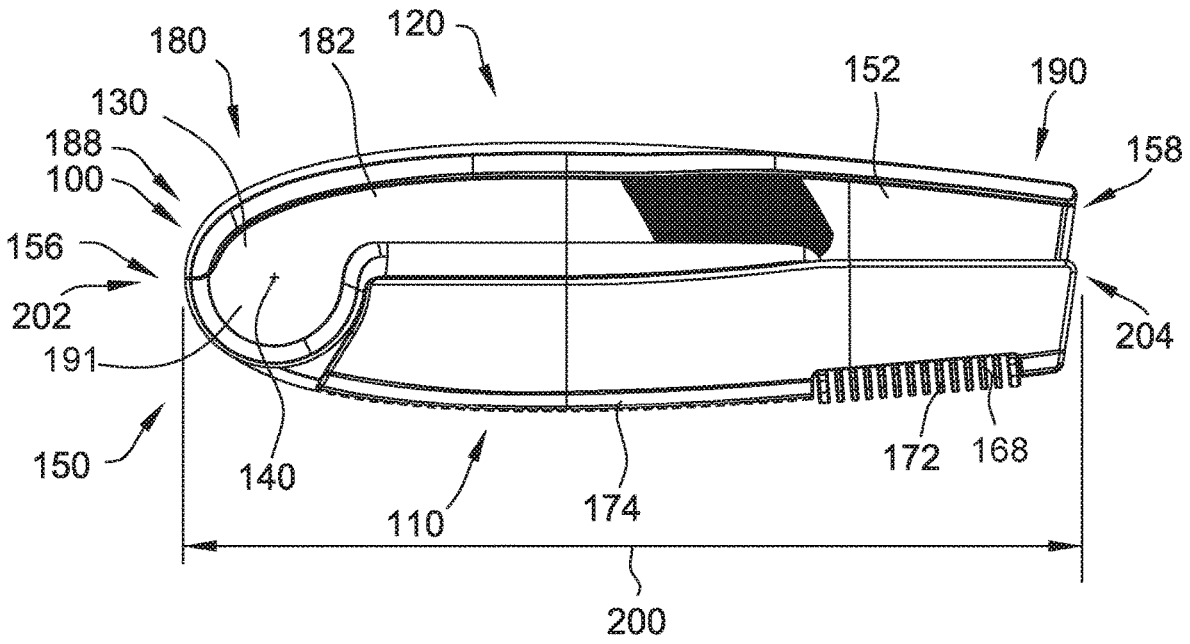
FIG. 1 is a right side view of a hair grooming appliance.
Figure 2:
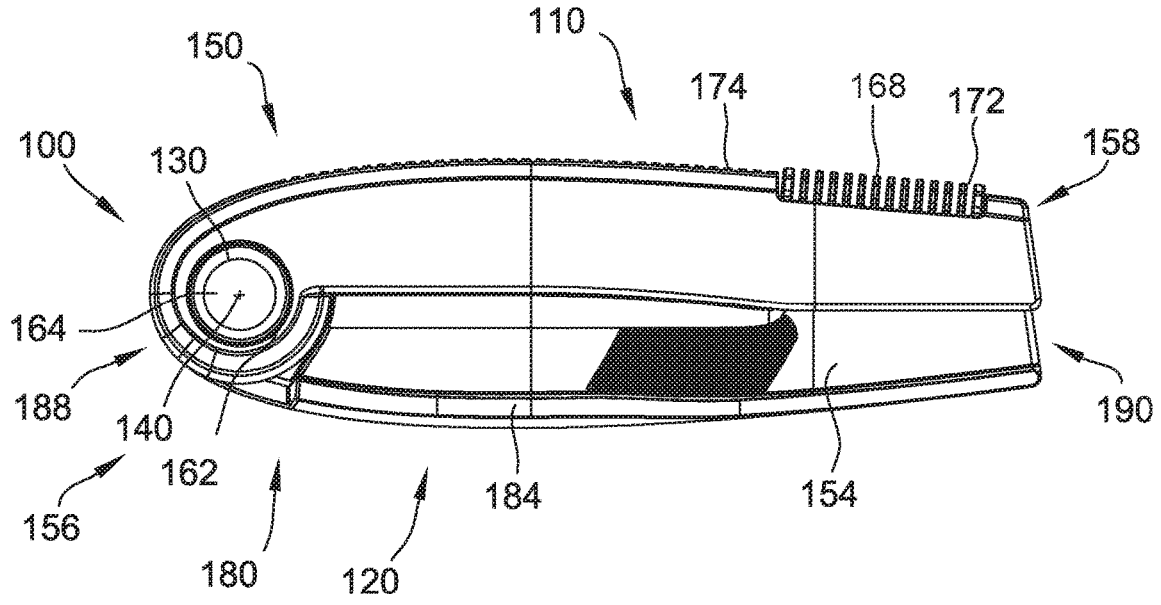
FIG. 2 is a left side view of the hair grooming appliance shown in FIG. 1 rotated and flipped such that the top (as seen in FIG. 1) of the hair grooming appliance is oriented down.
Figure 3:
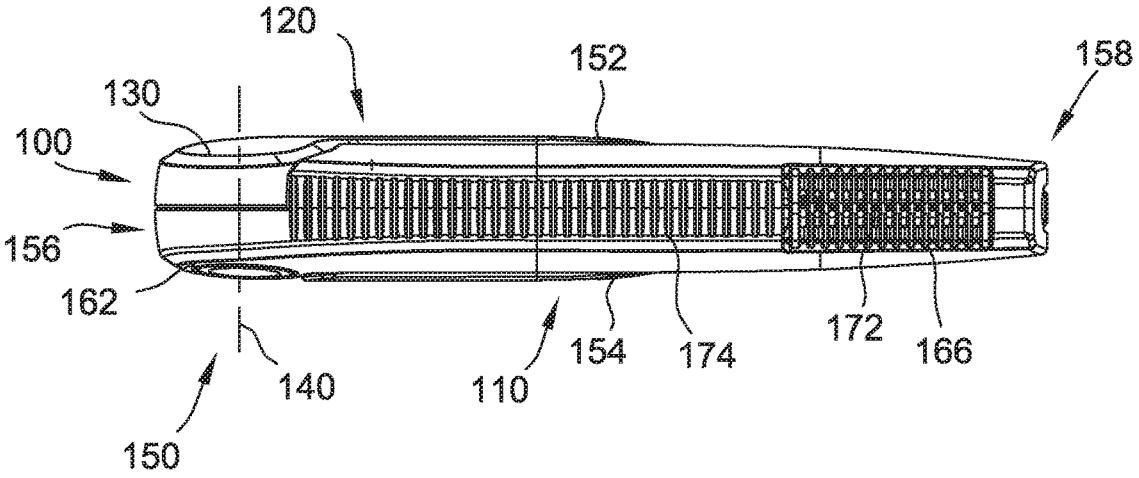
FIG. 3 is a bottom view of the hair grooming appliance shown in FIG. 1.
Figure 4:
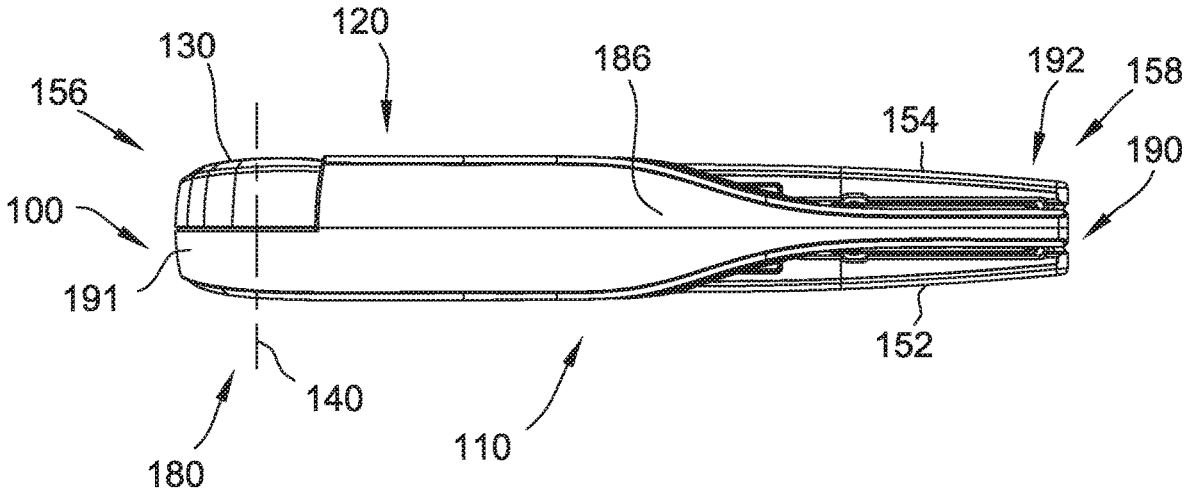
FIG. 4 is a top view of the hair grooming appliance shown in FIG. 1.
Figure 5:
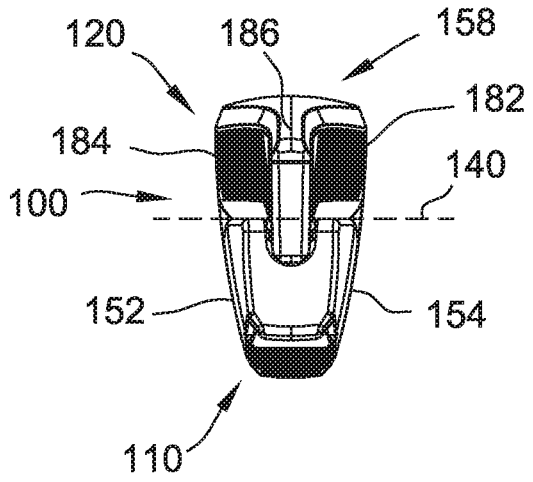

In the following specification and the claims, reference will be made to a number of terms, which shall be defined to have the following meanings. The singular forms "a," "an," and "the" include plural references unless the context clearly dictates otherwise. The terms "comprising," "including," and "having" are intended to be inclusive and mean that there may be additional elements other than the listed elements. "Optional" or "optionally" means that the subsequently described event or circumstance may or may not occur, and that the description includes instances where the event occurs and instances where it does not.

The present disclosure contemplates multiple embodiments of an electric hair grooming appliance illustrated in the accompanying drawings. As explained in more detail below, the disclosed embodiments of the hair grooming appliance are configured to have at least one operation which facilitates grooming of hair and comprises a battery, a motor, and a drive mechanism. In the disclosed embodiment, the battery powers the motor which in turn drives a hair grooming device such as blade assembly via the drive mechanism. The electric hair grooming appliance further comprises a housing consisting of two parts: a grooming device housing and a handle. At least a portion of the blade assembly, the motor, and the drive mechanism may be housed within the grooming device housing. In some embodiments, the grooming device also includes a hair removal assembly such as a foil shaver facing opposite the blade assembly. The battery may be housed either within the trimmer or the handle. The grooming device housing and the handle are connected at one end of the electric hair grooming appliance such that the electric hair grooming appliance can foldably close and have pivotable movements similar to a straightedge razor. Additionally, opening and closing the hair grooming appliance as described in more detail below can turn on and off the hair grooming appliance. As a result, the hair grooming appliance can be easily stored and transported without the grooming device being exposed to damage. Suitably, the hair grooming appliance is sized to fit within a pocket of the user. Moreover, the hair grooming appliance may be switched between the opened and closed position with one hand.

Referring now to the drawings, and in particular to FIGS. 1-6, 9, and 10, in the illustrated embodiment, a hair grooming appliance is generally indicated at 100. The illustrated hair grooming appliance 100 is in the form of a hair trimming appliance. It is understood, however, that the concepts disclosed herein may be used in other portable electric handheld grooming appliances, such as without limitation, rotary shavers, foil shavers, hair clippers, and epilators.

Figure 9:
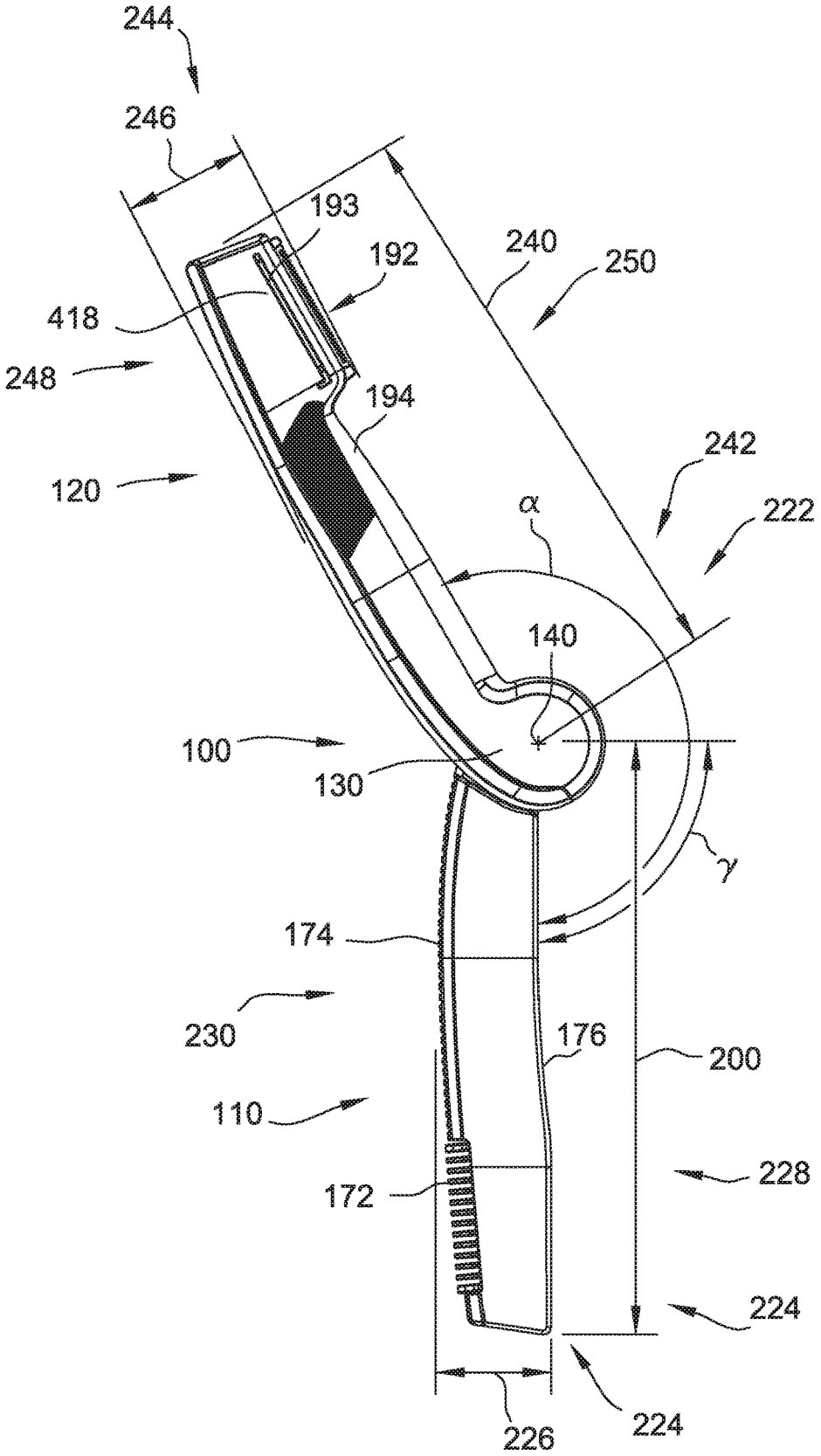
FIG. 9 is a right side view of the hair grooming appliance shown in FIG. 1 in an opened position.
Figure 10:
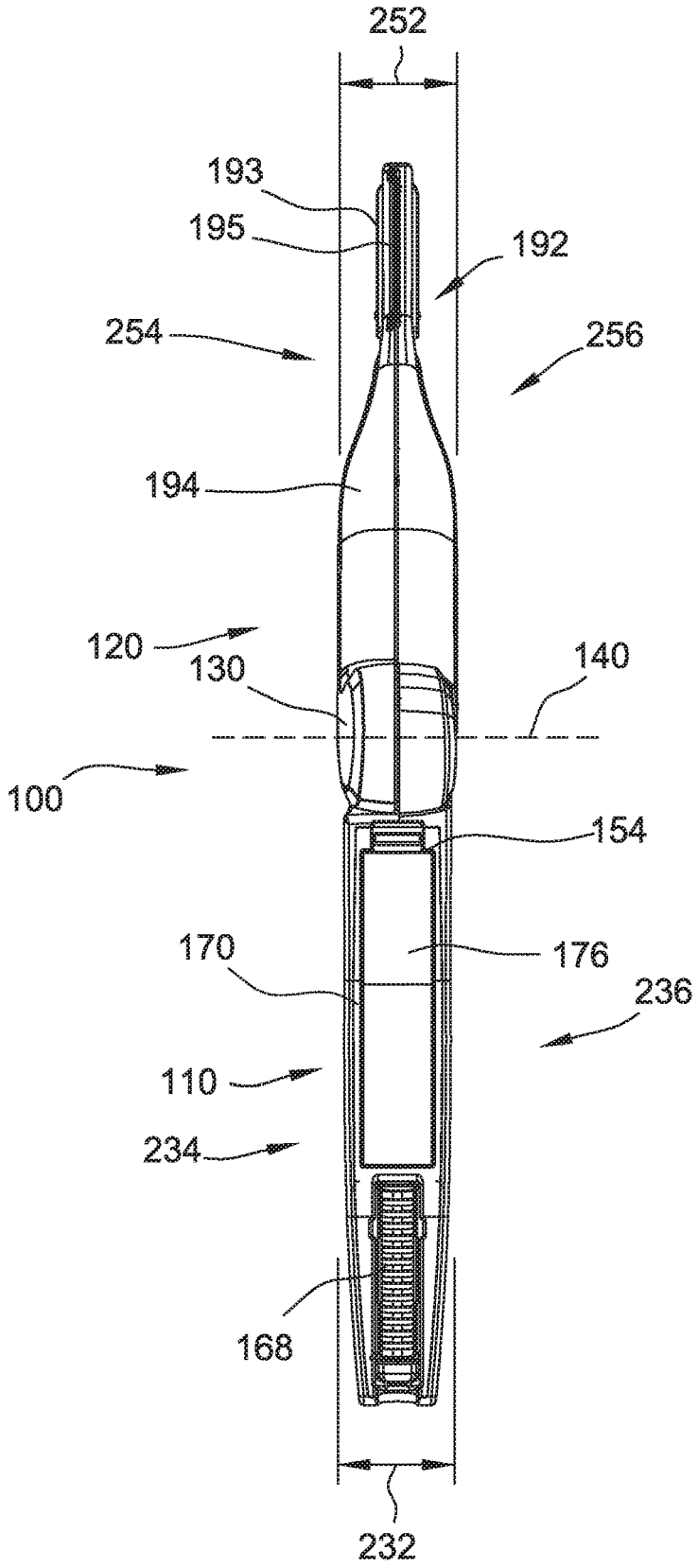
FIG. 10 is a top view of the hair grooming appliance shown in FIG. 1 in an opened position.
Figure 12:
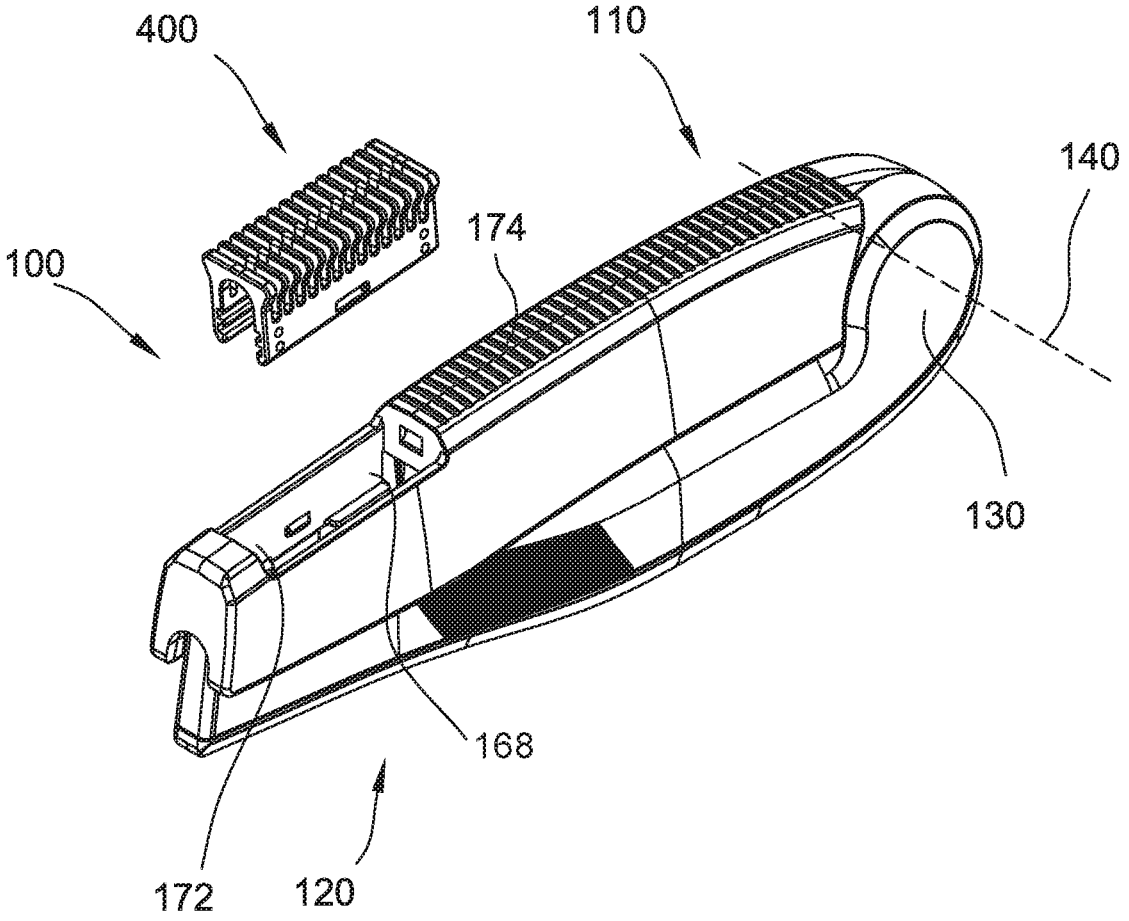
FIG. 12 is a perspective view of the comb shown in FIG. 11 removed and spaced from the hair grooming appliance shown in FIG. 1.
Figure 13:
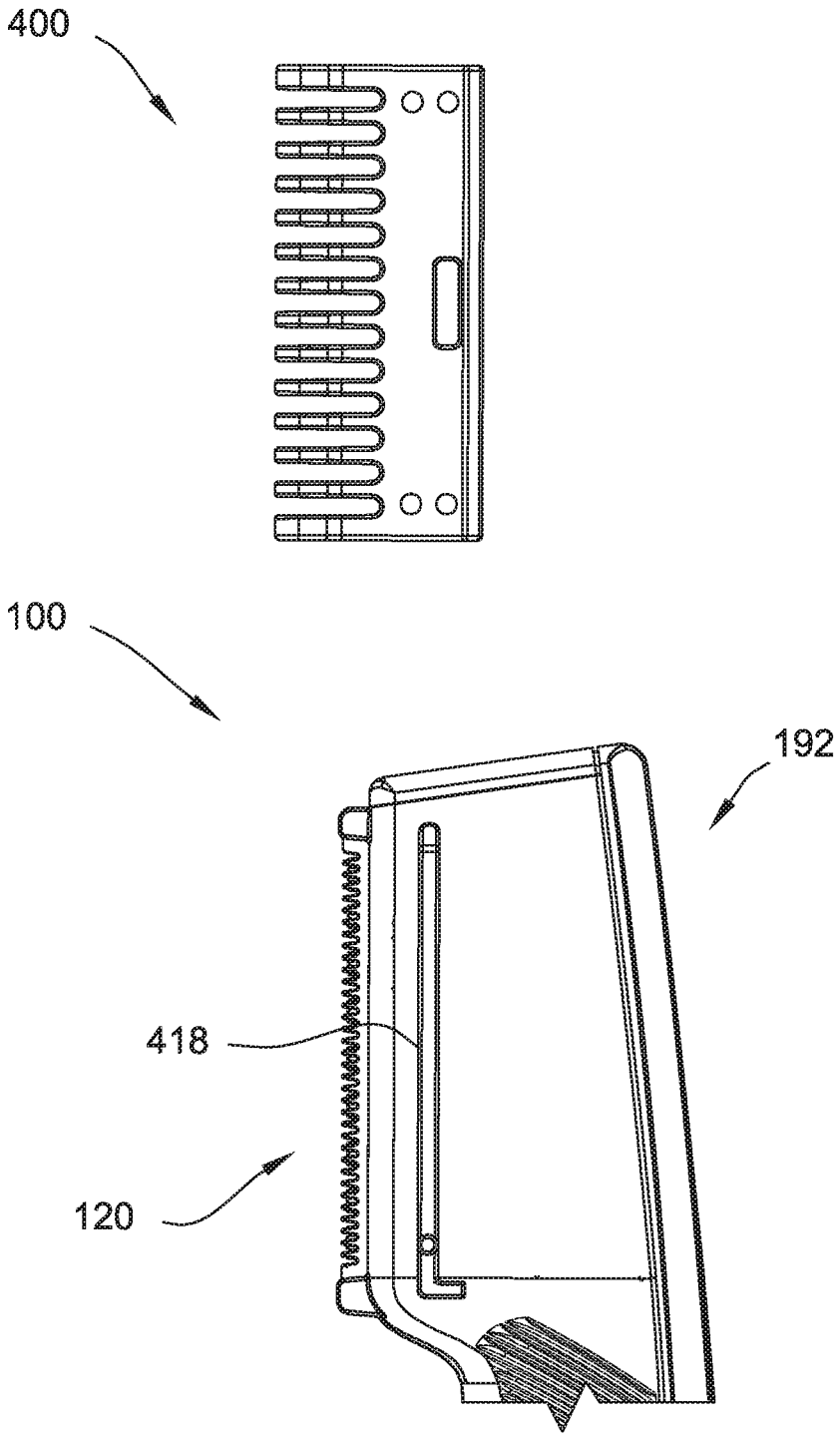
FIG. 13 is a side view of the comb shown in FIG. 11 and a portion of the hair grooming appliance shown in FIG. 1.

The hair grooming appliance 100 includes a handle indicated generally at 110, and a trimmer, broadly a hair grooming device, indicated generally at 120. The handle 110 is suitably sized and shaped so that it is easily held in a user's hand. The handle 110 and trimmer 120 are connected at one end of the hair grooming appliance 100 by a hinge 130 which enables the handle 110 and the trimmer 120 to rotate and, more specifically, pivot relative to each other about a pivot axis 140 extending through a center of the hinge 130. As a result, the hair grooming appliance has an "opened" position and a "closed" position. FIGS. 1-8 and 12 illustrate the hair grooming appliance 100 in the closed position, and FIGS. 9-10 and 13 illustrate the hair grooming appliance in the opened position.

Figure 11:
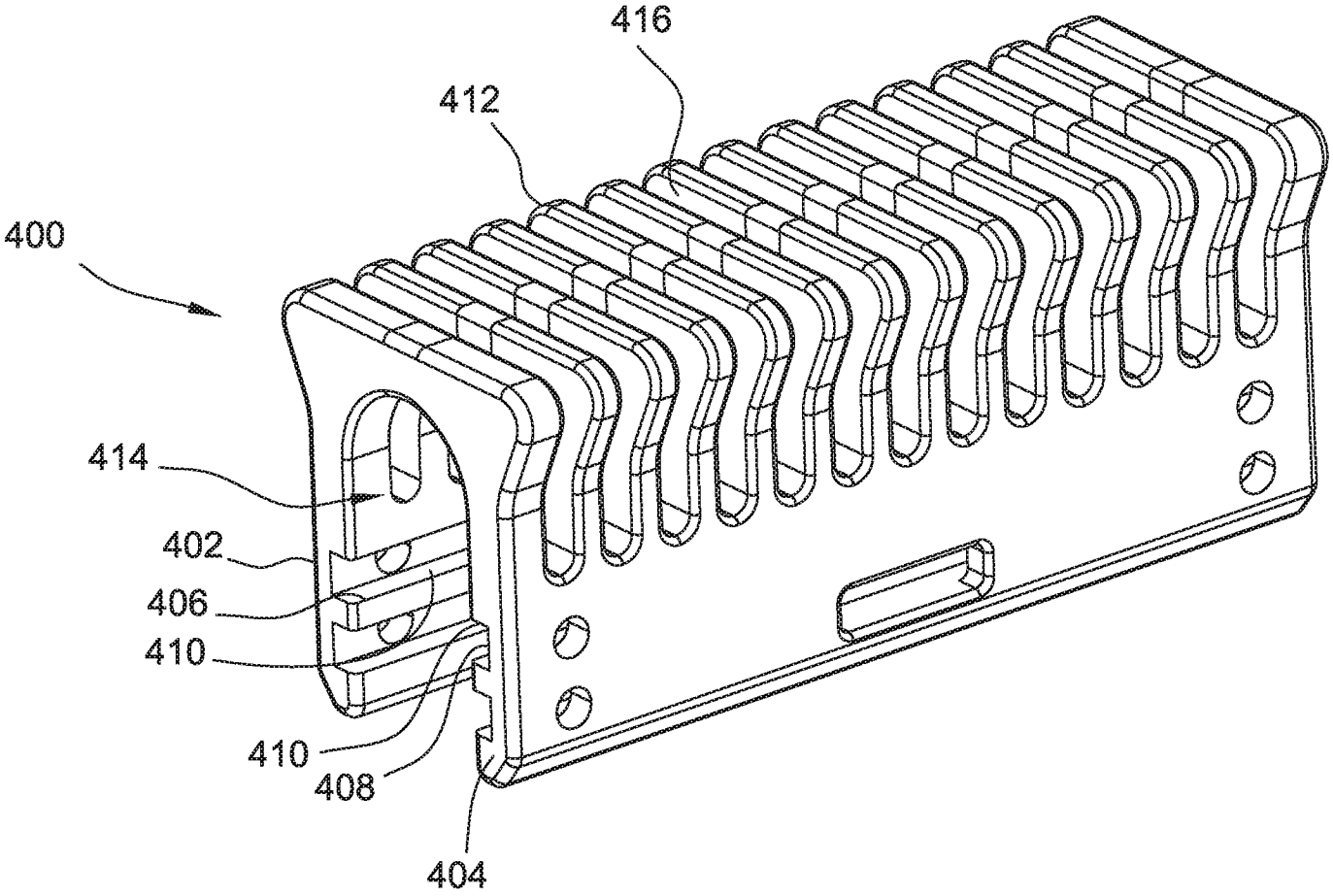
FIG. 11 is a perspective view of a comb of the hair grooming appliance.

The handle 110 includes an outer handle shell 150 and a battery cover 154. The outer handle shell 150 defines a rear end 156 and a front end 158 of the handle 110. In addition, the outer handle shell 150 defines an annular opening 162 located on the rear end 156 and configured to receive a hinge cap 164. The outer handle shell 150 further defines a front end receiving slot 168 on an inner side 170 of handle 110 and a comb receiving slot 172 on an outer side 174 of handle 110. The front end receiving slot 168 is suitably sized and shaped as to receive a grooming head portion 192 when hair grooming appliance 100 is configured in the closed position as illustrated in FIGS. 1-8. The comb receiving slot 172 is suitably sized and shaped as to receive a comb 400 (FIGS. 11-13). The battery cover 154, as seen in FIG. 10, substantially defines a handle flat portion 176 on the inner side 170 of handle 110. The battery cover 154 may be removed from the handle 110 by pressing a clip. The handle 110 includes a back or rear end 222, a front end 224, a top end 228, a bottom end 230, a right side 234, a left side 236. In another embodiment, the front end receiving slot 168 is suitably sized and shaped as to receive the grooming head portion 192 with the comb 400 attached to the grooming head portion 192 when hair grooming appliance 100 is configured in the closed position as illustrated in FIGS. 1-8.

The trimmer 120 includes an outer trimmer shell 180 which includes a right trimmer body 182, a left trimmer body 184, and a back cover 186—the assembly of which defines a rear end 188 and a front end 190 of the trimmer. A portion of the right trimmer body 182 defines a trimmer hinge cover 191. The right trimmer body 182 and the left trimmer body 184 each include a tapering shape that complement each other such that, when assembled, the front end 190 is narrower than the rear end 188 and the grooming head portion 192 is defined. Additionally, the grooming head portion 192 includes a blade extension 193 which extends from outer trimmer shell 180 such that, when hair grooming appliance 100 is configured in the closed position, the blade extension 193 extends into the front end receiving slot 168. The blade extension 193 defines a blade slot 195. The back cover 186 is coupled to the back of the combined right trimmer body 182 and left trimmer body 184 to form the outer trimmer shell 180. The outer trimmer shell 180 includes a trimmer flat portion 194 with a complementary shape to handle flat portion 176 such that, when hair grooming appliance 100 is configured in the closed position, trimmer flat portion 194 is substantially flush with handle flat portion 176. The trimmer 120 includes a back end 242, a front end 244, a top end 248, a bottom end 250, a right side 254, and a left side 256.

Figure 6:
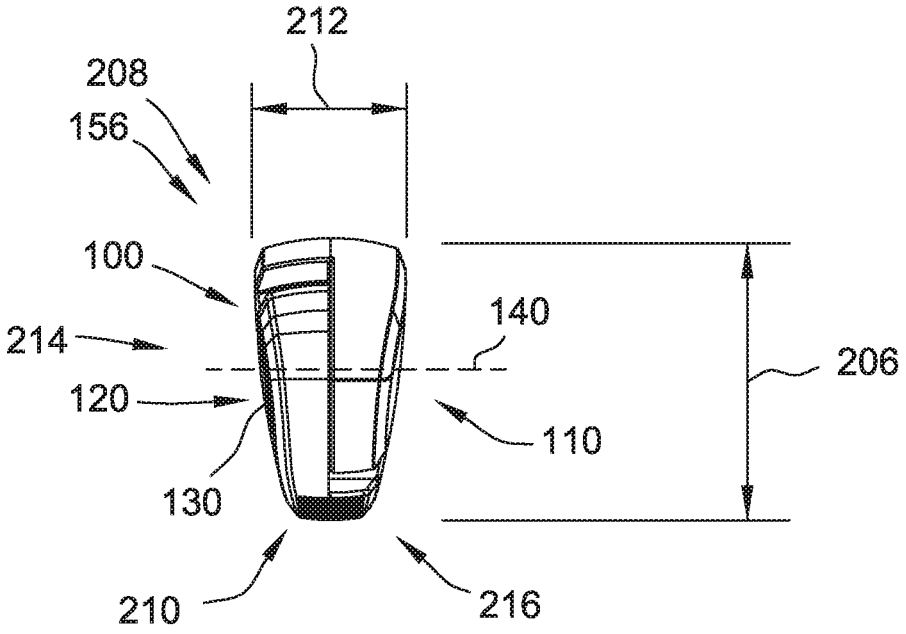
FIG. 6 is a rear end view of the hair grooming appliance shown in FIG. 1.

In the illustrated embodiment, the hair grooming appliance 100 includes a length 200 from a back end 202 to a front end 204 of hair grooming appliance 100 (FIG. 1). Length 200 is the length of the hair grooming appliance 100 at its greatest value in its closed position. The hair grooming appliance 100 also includes a depth (or height) 206 from a top end 208 to a bottom end 210 of hair grooming appliance 100 (FIG. 6). Depth 206 is the depth of the hair grooming appliance 100 at its greatest value in its closed position. As also illustrated in FIG. 6, the hair grooming appliance 100 further includes a width 212 from a right side 214 to a left side 216 of hair grooming appliance 100. Width 212 is the width of the hair grooming appliance 100 at its greatest value in the closed position.

Length 200 may be any value between about 3.5 inches and about 5.0 inches. Depth 206 may be any value between about 1.0 inches and about 1.75 inches. Width 212 may be any value between about 0.5 inches and about 1.0 inches. The ratio of length 200 to depth 206 can be any value between about 2.0 and about 5.0. The ratio of length 200 to width 212 can be any value between about 3.5 and about 10.0. The ratio of depth 206 to width 212 can be any value between about 1.0 and about 3.5.

Figure 7:
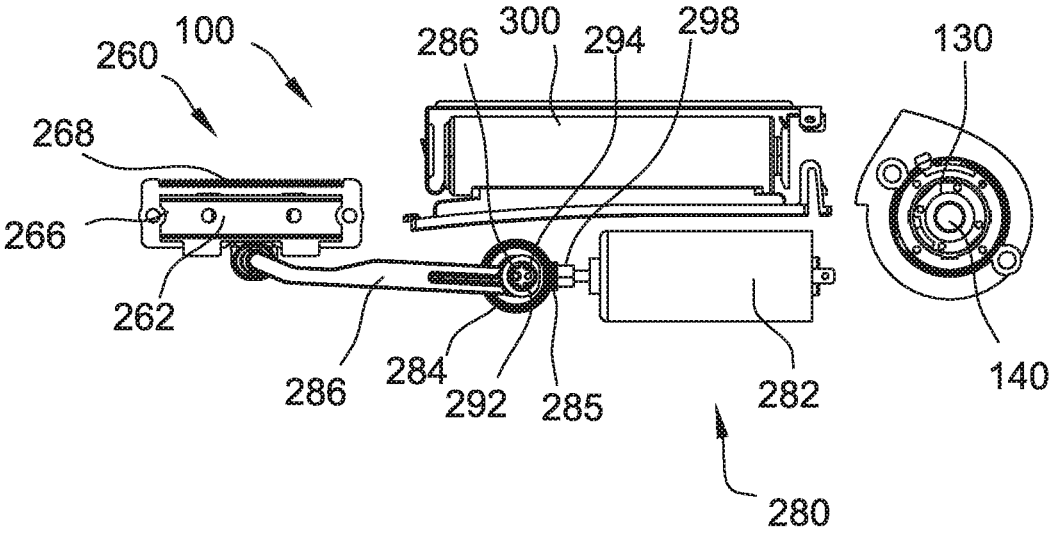
FIG. 7 is a right side view of an interior of the hair grooming appliance shown in FIG. 1 flipped such that the top (as seen in FIG. 1) of the hair grooming appliance is oriented down.
Figure 8:
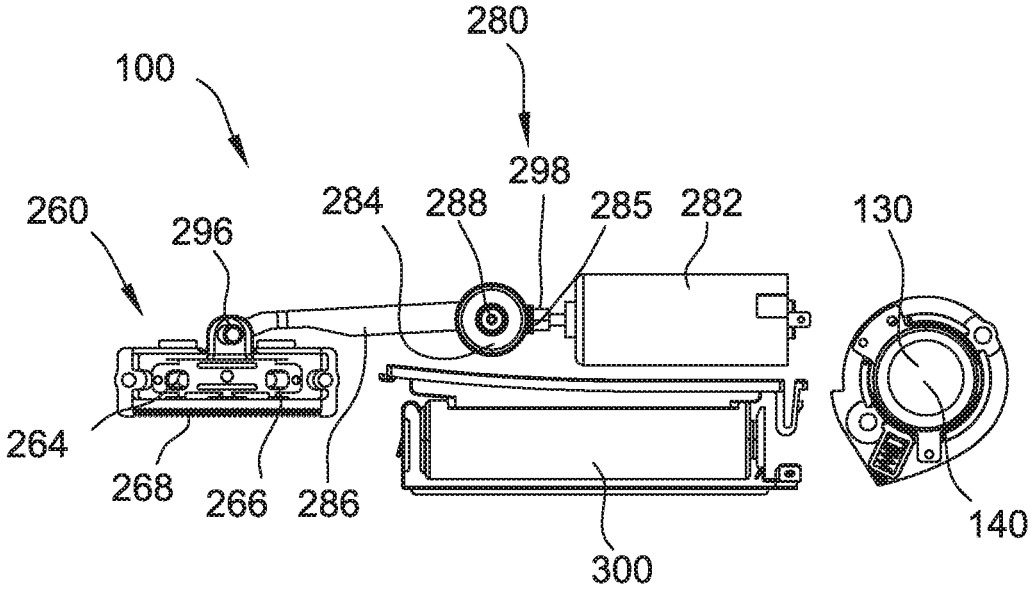
FIG. 8 is a rotated left side view of the interior of the hair grooming appliance shown in FIG. 1.

Referring now to FIGS. 7-8, in the illustrated embodiment, a blade assembly, indicated generally at 260, and a drive mechanism, indicated generally at 280, for operating the blade assembly 260 are housed within the trimmer 120. Portions of the hair grooming appliance 100 have been omitted from FIGS. 7-8 to show interior components of the hair grooming appliance. Together, the blade assembly 260 and drive assembly 280 constitute a hair trimming assembly. However, hair grooming appliance 100 may include any hair grooming device that enables hair grooming appliance 100 to operate as described herein, including clippers, trimmers, and hair removing devices such as epilators and shavers.

The blade assembly 260 generally includes a stationary blade 262 and a reciprocating blade 264 disposed within the grooming head portion 192. The stationary blade 262 and the reciprocating blade 264 both include a blade body 266 and a plurality of teeth 268 extending from the blade body 266. The blade bodies 266 of the stationary blade 262 and the reciprocating blade 264 are positioned adjacent each other within the grooming head portion 192. The teeth 268 extend from blade bodies 266 of the stationary blade 262 and the reciprocating blade 264 into the blade slot 195 of the blade extension 193 such that the teeth 268 are exposed for trimming hair when hair grooming appliance 100 is in the opened position. The drive assembly 280 is configured to drive reciprocating motion of the reciprocating blade 264 relative to the stationary blade 262. Such reciprocating motion of the reciprocating blade 264 cuts hair disposed between the teeth 268.

The drive assembly 280 generally includes an electric drive motor 282, a gear 284, a linkage 286, and a pivot pin 288. The drive motor 282 may be powered by one or more batteries 300 within the handle 110 and/or by another suitable internal or external electrical power source. In the illustrated embodiment, the battery 300 is housed in a battery compartment of the handle 110 of the hair grooming appliance 100. However, the battery 300 may also be housed in the trimmer 120 of the hair grooming appliance 100. In the illustrated embodiment, the battery 300 is a rechargeable battery. However, the battery 300 may also be any type of battery that enables the hair grooming appliance 100 to operate as described herein. The electric drive motor 282 includes a drive shaft 298 extending from the electric drive motor 282 and configured to rotate the gear 284 with a drive shaft gear 285. The pivot pin 288 pivotally connects the gear 284 to the trimmer 120. The gear 284 has a linking pin 292 and is pivotable about the pivot pin 288. The linkage 286 is a generally linear arm having, at opposing ends of the arm, a linking slot 294 and a linking pin 296. The linking slot 294 receives the linking pin 292 of the gear 284, rotatably connecting the linkage 286 to the gear 284 radially outward from a center of the gear 284. The linking pin 296 extends from the linkage 286 to the reciprocating blade 264, connecting the linkage 286 to the reciprocating blade 264.

During operation of the hair grooming appliance 100, the gear 284 is rotated about the pivot pin 288 by the drive shaft 298 and the drive shaft gear 285. Because the linkage 286 is rotatably coupled to the gear 284 radially outward from the center of the gear 284, the rotation of the gear 284 about the pivot pin 288 causes a back-and-forth linear movement (or translatory motion) of the linkage 286. The blades 262, 264 are arranged in shearing, face-to-face contact with one another, and the reciprocating blade 264 is seated on the linking pin 296 of the linkage 286. In the illustrated embodiment, for example, the reciprocating blade 264 is operatively connected to the electric drive motor 282 by the linkage 286 such that the reciprocating blade 264 is reciprocated relative to the first or stationary blade 262 in what is referred to herein as a working direction of the reciprocating blade 264 to trim hair upon operation of the electric drive motor 282.

With the blade assembly 260 (e.g., a movable blade of the blade assembly 260) being seated on the linkage 286 via the blade linking pin 296, the blade assembly 260 is actuated by the linear movement of the linkage 286, thereby reciprocating the reciprocating blade 264 in the working direction relative to the stationary blade 262 to shear off hairs that enter the gaps between the respective teeth of the blades. In the illustrated embodiment, the blades 262, 264 of the blade assembly 260 extend generally parallel to the length 200 of the hair grooming appliance 100 to provide a relative long, narrow profile of the blade assembly 260 for ease of positioning the blade assembly 260 in a user's nose or ear. In other suitable embodiments, the blade assembly 260 may have any other suitable blade orientation that enables the grooming appliance 100 to operate as described herein.

Figure 15:
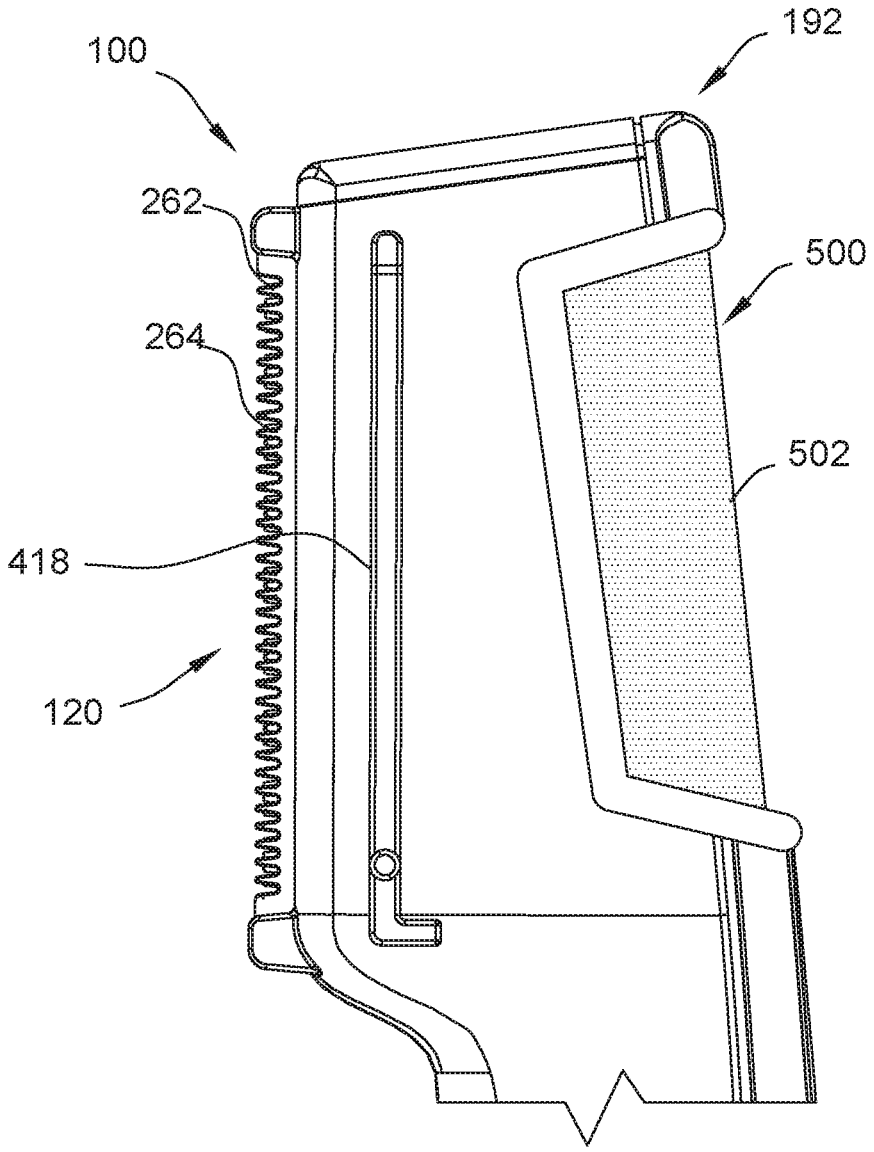
FIG. 15 is a side view an alternative hair grooming device for the hair grooming appliance shown in FIG. 1, the hair grooming device including a trimmer assembly and a hair removal assembly.

In another embodiment, the hair grooming appliance 100 may include a second hair grooming device such as a hair removing device facing opposite the stationary and reciprocating blades of the blade assembly 260. For example, in one embodiment shown in FIG. 15, the hair grooming appliance 100 includes a foil shaver, broadly a hair removing assembly, 500 opposite the blades 262, 264. The foil shaver 500 may be operable when the hair grooming appliance 100 is in the opened position and the closed position. In some embodiments, the foil shaver 500 is switched between an ON position and an OFF position by a switch or actuator. In the illustrated embodiment, the foil shaver 500 includes an inner blade (not shown) that is reciprocated relative to an outer blade or foil 502. The inner blade may be driven by the drive assembly 280 when the hair grooming appliance 100 is in the closed position and may disconnected from the drive assembly 280 when the hair grooming appliance 100 is in the opened position. The hair grooming appliance 100 may be of other configurations without departing from the scope of the present disclosure.

Referring now to FIGS. 9-10, in the illustrated embodiment, the handle 110 and trimmer 120 are connected at one end of the hair grooming appliance 100 by the hinge 130 which enables the handle 110 and trimmer 120 to rotate (or pivot) relative to each other about the pivot axis 140. The hair grooming appliance 100 is in the opened position in FIGS. 9-10. Angle $\alpha$ is the maximum angle of rotation possible as the trimmer 120 is rotated about pivot axis 140 relative to the handle 110. Angle $\alpha$ may be any value between 90.0 degrees and 340.0 degrees. In the illustrated embodiment, for example, angle $\alpha$ is approximately 210 degrees.

In some embodiments, rotating trimmer 120 about pivot axis 140 beyond an angle $\gamma$, where angle $\gamma$ is less than or equal to angle $\alpha$, causes an electrical connection between a power source, such as the battery 300, and the electric drive motor 282 to be established. The electric drive motor 282 may be coupled to the blade assembly 260 such that rotating trimmer 120 beyond angle $\gamma$ causes the blade assembly 260 to begin a reciprocating motion of the reciprocating blade 264 relative to the stationary blade 262, effectively setting the hair grooming appliance 100 to an ON state. In such an embodiment, the hair grooming appliance 100 may be set to an OFF state by rotating trimmer 120 such that the angle of rotation is less than angle $\gamma$. Angle $\gamma$ may be any value between 30.0 degrees and 120.0 degrees. In the exemplary embodiment, for example, angle $\gamma$ is 90 degrees.

Figure 14:
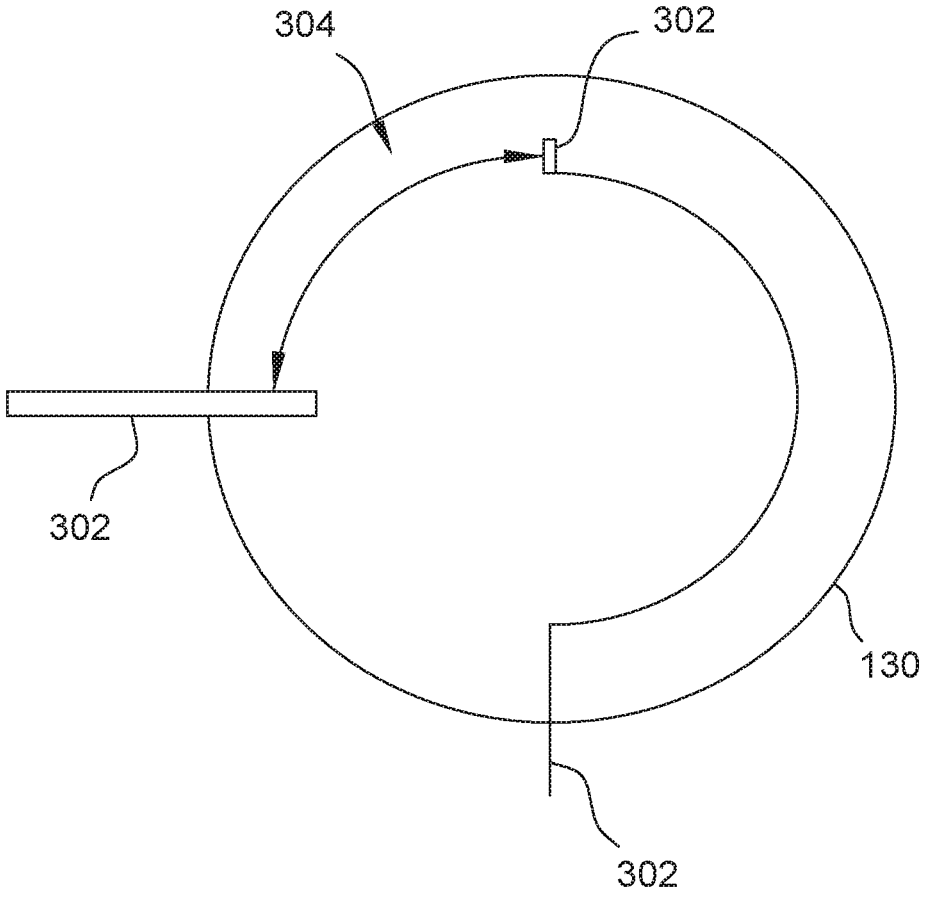
FIG. 14 is schematic diagram of a switch of the hair grooming appliance shown in FIG. 1.

As shown in FIG. 14, in the illustrated embodiment, at least one connection and/or contact 302 to transfer electrical current from the battery 300 to the electric drive motor 282 may be located at or adjacent the hinge 130. Additionally, a switch 304 which causes an electrical connection between a power source, such as the battery 300, and the electric drive motor 282 may be located at or adjacent the hinge 130. When the trimmer 120 is rotated beyond angle $\gamma$, connections within the switch contact each other and electrical current is transferred from the battery 300 to the electric drive motor 282.

As a result, the hair grooming appliance shown and described herein can be selectively turn on and off by pivoting the handle 110 or trimmer 120 relative to the other about the pivot axis 140. That is, selectively moving the hair grooming appliance 100 to or towards its opened position from the closed position turns the hair grooming appliance on, and moving the hair grooming appliance to or towards it closed position from the opened position turns the hair grooming appliance off. Accordingly, a user can easily and readily turn the hair grooming appliance 100 off and on.

In another embodiment, the switch 304 which causes an electrical connection between a power source, such as the battery 300, and the electric drive motor 282 may be located anywhere on the hair grooming appliance 100 that enables the hair grooming appliance 100 to operate as described herein. For instance, the switch 304 may be located on the back or rear end 222, the front end 224, the top end 228, the bottom end 230, the right side 234, or the left side 236 of handle 110. Additionally, the switch 304 may be located on the back end 242, the front end 244, the top end 248, the bottom end 250, the right side 254, or the left side 256 of trimmer 120. Moreover, the switch 304 may include an external actuator which allows an operator to switch the hair grooming appliance between the ON and OFF states.

Referring now to FIGS. 11-13, in the illustrated embodiment, the hair grooming appliance 100 includes the comb 400 which is configured to be stored in the comb receiving slot 172 or to extend over the blades 262 and 264. The comb 400 includes two latching slats 402 and 404 separated from each other and arranged in a substantially parallel arrangement. The latching slats 402 and 404 each define a latching slot 406 and 408 extending along a length of an inner side 410 of the latching slats 402 and 404. The comb 400 also includes a plurality of comb teeth 412 extending from a top side of the latching slats 402 and 404. Each comb tooth 412 includes an arched shape such that a first side of the tooth 412 is coupled to the first latching slat 402 and a second side of the tooth 412 is coupled to the second latching slat 404. The comb teeth 412 and latching slats 402 and 404 define a blade cavity 414 sized and shaped to extend over and receive the blades 262 and 264. The comb teeth 412 are also separated from each other by a comb slot 416 sized and shaped to allow hair to extend into the blade cavity 414 where the blades 262 and 264 trim the hair.

As shown in FIG. 12, in the illustrated embodiment, when the comb 400 is not positioned on the blade assembly, the comb 400 may be stored in the comb receiving slot 172. The comb receiving slot 172 is sized and shaped to receive the latching slats 402 and 404. A plurality of latches (not shown) within the comb receiving slot 172 latch onto the latching slats 402 and 404 and retain the comb 400 within the comb receiving slot 172. As a result, the comb 400 is maintained in assembly with the hair grooming appliance 100 when not in use and the comb 400 is not loose and does not require a separate storage structure to protect the comb 400 or prevent the comb 400 from being separated from the hair grooming appliance 100. In alternative embodiments, the comb receiving slot 172 may have any other suitable comb retention mechanism that enables the grooming appliance 100 to operate as described herein.

As shown in FIG. 13, in the illustrated embodiment, when hair grooming appliance 100 is in use, the comb 400 extends over the blades 262 and 264. The front end 190 of the trimmer 120 includes two latching protrusions 418 extending from opposite sides of the front end 190 of the trimmer 120. The latching slots 406 and 408 are sized and shaped to receive the latching protrusions 418 and to maintain the position of the comb 400 on the trimmer 120 during hair trimming operations. In other suitable embodiments, the front end 190 of the trimmer 120 may have any other suitable comb 400 retention mechanism that enables the grooming appliance 100 to operate as described herein. During of the operation of the hair grooming appliance 100, the comb slots 416 allow hair to extend into the blade cavity 414 where the blades 262 and 264 trim the hair when the comb 400 is positioned on the blade assembly. As such, the comb 400 separates the hair grooming appliance 100 from the user's skin and the base of the user's hair, allowing the grooming appliance 100 to trim the user's hair to a longer, predetermined length.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A hair grooming appliance comprising:

a hair grooming device including a first blade and a second blade;

a drive assembly coupled to the hair grooming device and configured to drive the hair grooming device; and a handle defining a battery compartment configured to receive at least one battery, wherein the hair grooming device and the handle are pivotably connected at a hinge and rotate relative to each other about a pivot axis extending through the hinge, wherein the hair grooming device and the handle are configured to pivot between an opened position and a closed position;

wherein the hair grooming appliance has a length from a back end to a front end of the hair grooming appliance in the closed position, the first blade and the second blade extending parallel to the length of the hair grooming appliance in the closed position.

2. The hair grooming appliance of claim 1, wherein the handle and the hair grooming device are able to rotate relative to each other about the pivot axis between the closed position and the opened position, wherein the hinge is at an end of the hair grooming appliance when the hair grooming appliance is in the closed position.

3. The hair grooming appliance of claim 1, wherein the battery is configured to provide an electrical current to the drive assembly.

4. The hair grooming appliance of claim 3, wherein the battery comprises a rechargeable battery.

5. The hair grooming appliance of claim 1, wherein the drive assembly is selectively moveable between an ON state and an OFF state by a switch.

6. The hair grooming appliance of claim 1, wherein the drive assembly is selectively moveable between an ON state and an OFF state by movement of the handle relative to the hair grooming device about the pivot axis.

7. The hair grooming appliance of claim 6, wherein at least one of the first blade and the second blade is operatively connected to the drive assembly for driven movement relative to the other one of the first blade and the second blade when the drive assembly is in the ON state.

8. The hair grooming appliance of claim 7, wherein the drive assembly is in the ON state when the hair grooming device and the handle are in the opened position.

9. A hair grooming appliance comprising:

a trimmer comprising a blade assembly and a drive assembly coupled to the blade assembly, the drive assembly including an electric drive motor and a linkage, the motor coupled to the linkage and the linkage coupled to the blade assembly and configured to reciprocate at least one blade of the blade assembly; and a handle defining a battery compartment configured to receive at least one battery, wherein the trimmer and handle are pivotably connected at an end of the hair grooming appliance, wherein the trimmer and the handle are configured to pivot between an opened position and a closed position;

wherein the hair grooming appliance has a length from a back end to a front end of the hair grooming appliance in the closed position, the at least one blade extending parallel to the length of the hair grooming appliance in the closed position.

10. The hair grooming appliance of claim 9, wherein the trimmer includes a blade head configured to house the blade assembly.

11. The hair grooming appliance of claim 10, wherein the handle defines a blade head receiving slot on a first side of the handle, wherein the blade head receiving slot is configured to receive the blade head when the trimmer and the handle are in the closed position.

12. The hair grooming appliance of claim 11 further comprising a comb configured to extend over the blade head and the hair removing assembly when the trimmer and the handle are in the opened position.

13. The hair grooming appliance of claim 12, wherein the handle further defines a comb receiving slot on a second side of the handle, wherein the comb is configured to be stored in the comb receiving slot when the trimmer and the handle are in the closed position.

14. The hair grooming appliance of claim 12, wherein the blade head receiving slot is configured to receive the blade head and the comb attached to the blade head when the trimmer and the handle are in the closed position and the comb is positioned on the blade head.

15. The hair grooming appliance of claim 9, wherein the handle and the trimmer are able to rotate relative to each other about an axis located at an end of the hair grooming device.

16. The hair grooming appliance of claim 9, wherein the battery is configured to provide an electrical current to the electric drive motor.

17. The hair grooming appliance of claim 9, wherein the electric drive motor is selectively moveable between an ON state and an OFF state by pivoting the handle relative to the trimmer.

18. The hair grooming appliance of claim 17, wherein the blade assembly includes a first blade and a second blade, one of the first blade and the second blade being operatively connected to the drive assembly for driven movement relative to the other one of the first blade and the second blade when the electric drive motor is in the ON state.

19. The hair grooming appliance of claim 18, wherein the drive assembly is in the ON state when the trimmer and the handle are configured in the opened position.

20. The hair grooming appliance of claim 9 further comprising a hinge coupled to the trimmer and the handle, wherein the hinge includes a switch configured to switch the electric drive motor to an ON state when the trimmer and the handle are in the opened position.

21. A hair grooming appliance comprising:

a hair grooming device comprising at least one of a hair cutting assembly and a hair removing assembly;

a drive assembly coupled to the hair grooming device and configured to drive the hair grooming device;

a handle defining a battery compartment configured to receive at least one battery; and a hinge pivotably connecting the handle and the hair grooming device, the hair grooming device and the handle being configured to pivot between an opened position and a closed position about the hinge, wherein the drive assembly is in an ON state when the hair grooming device and the handle are in the opened position, the drive assembly being in an OFF state when the hair grooming device and the handle are in the closed position;

wherein the hair grooming appliance has a length from a back end to a front end of the hair grooming appliance in the closed position, the hair grooming device extending parallel to the length of the hair grooming appliance in the closed position.

* * * * *